US011057711B2

(12) United States Patent
Wu

(10) Patent No.: US 11,057,711 B2
(45) Date of Patent: Jul. 6, 2021

(54) SPEAKER

(71) Applicant: AAC Technologies Pte. Ltd., Singapore (SG)

(72) Inventor: Shuwen Wu, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/702,571

(22) Filed: Dec. 4, 2019

(65) Prior Publication Data

US 2020/0213750 A1 Jul. 2, 2020

(30) Foreign Application Priority Data

Dec. 27, 2018 (CN) ..... 201811619057.4

(51) Int. Cl.

| | |
|---|---|
| ***H04R 9/06*** | (2006.01) |
| ***H04R 7/12*** | (2006.01) |
| ***H04R 9/02*** | (2006.01) |
| ***H04R 31/00*** | (2006.01) |
| ***H04R 7/18*** | (2006.01) |

(52) U.S. Cl.

CPC ..... *H04R 9/06* (2013.01); *H04R 7/12* (2013.01); *H04R 7/18* (2013.01); *H04R 9/025* (2013.01); *H04R 31/006* (2013.01); *H04R 2400/11* (2013.01)

(58) Field of Classification Search

CPC combination set(s) only.
See application file for complete search history.

(56) References Cited

U.S. PATENT DOCUMENTS

| | | | | |
|---|---|---|---|---|
| 2015/0016659 | A1* | 1/2015 | Wang | H04R 9/046 381/412 |
| 2018/0302723 | A1* | 10/2018 | Xiao | H04R 9/06 |
| 2019/0230442 | A1* | 7/2019 | Xiao | H04R 9/025 |
| 2020/0045466 | A1* | 2/2020 | Song | H04R 9/043 |
| 2020/0059728 | A1* | 2/2020 | Ding | H04R 1/2834 |

* cited by examiner

*Primary Examiner* — Fan S Tsang
*Assistant Examiner* — Angelica M McKinney
(74) *Attorney, Agent, or Firm* — W&G Law Group LLP

(57) ABSTRACT

A speaker, having a firmer structure, includes a metal holder, a magnetic circuit unit including a first diaphragm, and a vibration unit including a clamp plate. The clamp plate includes long-axis edges and short-axis edges. The holder includes long edges, short edges, and corner portions. The short edge includes a first surface facing away from the first diaphragm. The short-axis edge abuts against the first surface. The short-axis edge includes a second surface facing the short edge. The corner portion includes a third surface facing away from the first diaphragm. The holder further includes a protrusion extending from the first surface in a direction facing away from the first diaphragm. The clamp plate further includes an avoiding portion formed by recessing from the second surface in a direction facing away from the short edge. The protrusion is received in and connected to the avoiding portion.

7 Claims, 6 Drawing Sheets

SPEAKER

TECHNICAL FIELD

The present disclosure relates to the technical field of electronic apparatus, and in particular, to a speaker.

BACKGROUND

With the rapid development of wireless communication, there are more and more mobile phones around the world, and people's requirements on the mobile phones are not limited to basic communication, but more on reliability of traditional mobile phones, such as resistance to dropping and breaking, and resistance to vibration.

Regarding the speaker known in the related art, a metal holder is merely positioned in Z-direction, and a spot-welding position is only at a corner of the holder. Thus, such a structure results in that the speaker is likely to be deformed and warped at the center of a short axis of the holder after a dropping test.

Therefore, it is urgent to provide a new speaker to solve the above problems.

BRIEF DESCRIPTION OF DRAWINGS

Many aspects of the exemplary embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DESCRIPTION OF EMBODIMENTS

The present disclosure will hereinafter be described in detail with reference to several exemplary embodiments. To make the technical problems to be solved, technical solutions and beneficial effects of the present disclosure more apparent, the present disclosure is described in further detail together with the figure and the embodiments. It should be understood the specific embodiments described hereby is only to explain the disclosure, not intended to limit the disclosure.

Figure 1:
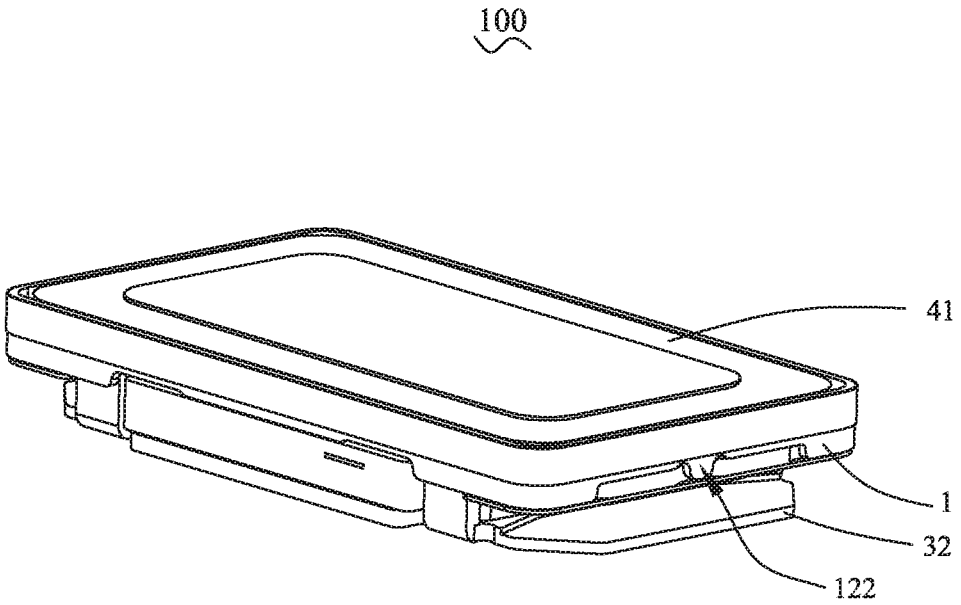
FIG. 1 is a structural diagram of a speaker provided by the present disclosure.
Figure 2:
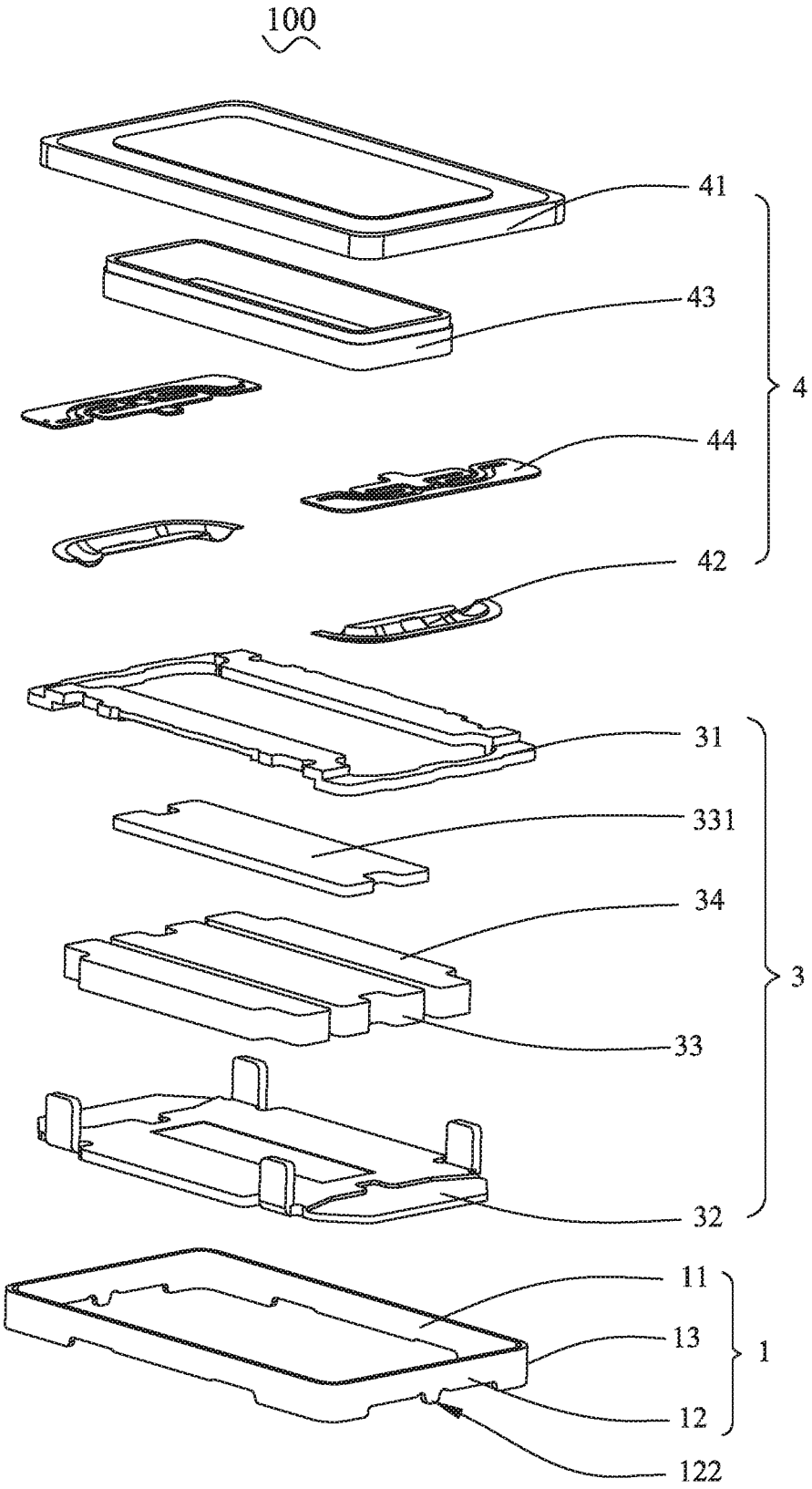
FIG. 2 is an exploded view of a speaker provided by the present disclosure.
Figure 3:
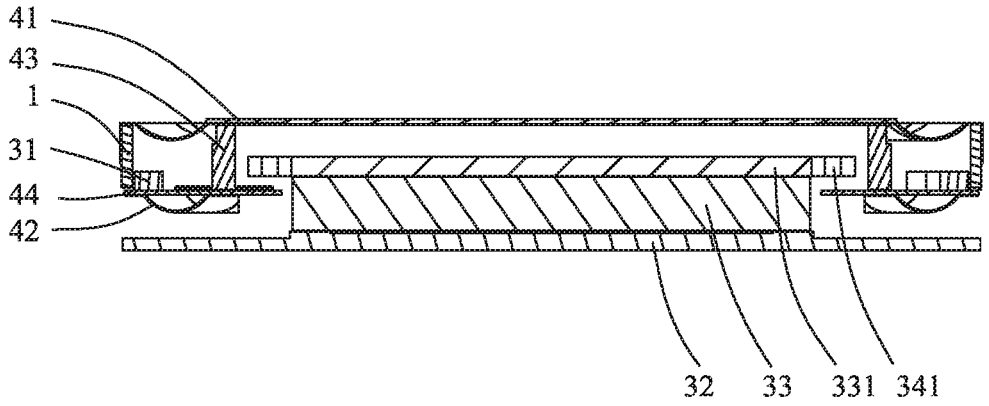
FIG. 3 is a cross-sectional view of a speaker provided by the present disclosure.

Referring to FIG. 1, FIG. 2 and FIG. 3, the present disclosure provides a speaker 100, which includes a metal holder 1, and a magnetic circuit unit 3, and a vibration unit 4. The magnetic circuit unit 3 and the vibration unit 4 are mounted to the holder 1.

The holder 1, as a whole, has a hollow rectangular shape. The holder 1 includes two long edges 11 arranged opposite to each other, two short edges 11 arranged opposite to each other, and corner portions 13 each connecting one long edge 11 and one short edge 12 that are adjacent.

The magnetic circuit unit 3 includes a clamp plate 31 mounted on the holder 1, a yoke 32, a main magnet 33 assembled at a center of the yoke 32, a main pole plate 331 attached to a surface of the main magnet 33, and two auxiliary magnets 34 assembled on the yoke 32 and located on two sides of the main magnet 33. The main magnet 33, as a whole, has a rectangular structure. The auxiliary magnets 34 are provided on two sides of the main magnet 33, and a magnetic gap is formed between one auxiliary magnet 34 and the main magnet 33.

The main pole plate 331 is used to conduct magnetism for the main magnet 33, so as to reduce outflow of magnetic force lines, thereby effectively increasing a driving force of the magnetic circuit unit 3.

Figure 4:
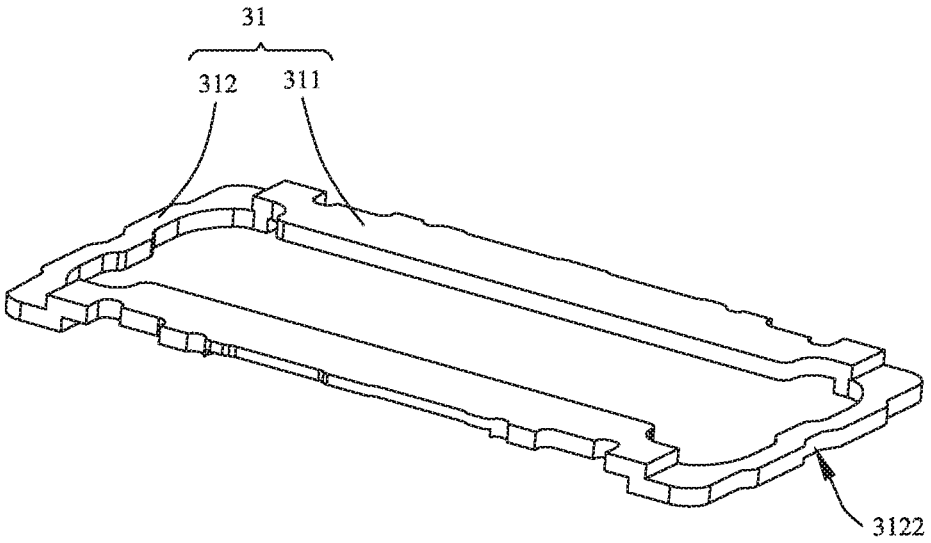
FIG. 4 is a structural diagram of a clamp plate provided by the present disclosure.

Referring to FIG. 2 and FIG. 4 together, the clamp plate 31 has a shape of rectangular frame, which includes a pair of oppositely arranged long-axis edges 311 and a pair of oppositely arranged short-axis edges 312. Each of the long-axis edges 311 and each of the short-axis edges 312 are connected end to end, to form the clamp plate 31.

For example, the two long-axis edges 311 are respectively attached to surfaces of the two auxiliary magnets 34, which simplifies a structure of the speaker 100.

The vibration unit 4 includes a first diaphragm 41 fixed to one end of the holder 1, a second diaphragm 42 fixed to the other end of the holder 1, a voice coil 43 located below the first diaphragm 41 and driving the first diaphragm 41 to vibrate and emit sound, and a flexible printed circuit board 44 elastically supporting the voice coil 43 and electrically connected to the voice coil 43.

One end of the second diaphragm 42 is fixed to the holder 1, and the other end is fixed to an end of the voice coil 43 facing away from the first diaphragm 41. The second diaphragm 42 effectively prevents a lateral sway of the voice coil 43 caused by a vibration of the first diaphragm 41, thereby effectively improving stability of the speaker 100. In addition, the second diaphragm 42 also improves a vibration intensity of the vibration unit 2 and thus improves the sounding performance.

The flexible printed circuit board 44 is electrically connected to the voice coil 43. The flexible printed circuit board 44 is interposed between the voice coil 43 and the second diaphragm 42. For example, the flexible printed circuit board 44 has one end fixed to the holder 1, and the other end fixedly supported at the end of the voice coil 43 facing away from the first diaphragm 41. This structural configuration can further increase a vibration intensity of the first diaphragm 41 and thus improves sound loudness of the speaker 100.

Figure 5:
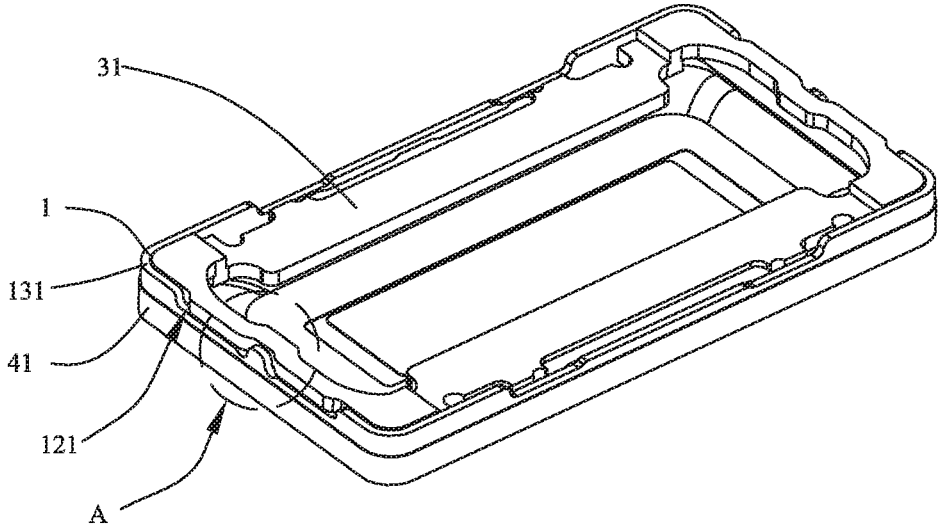
FIG. 5 is a diagram showing an assembly of a first diaphragm, a holder and a clamp plate provided by the present disclosure.
Figure 6:
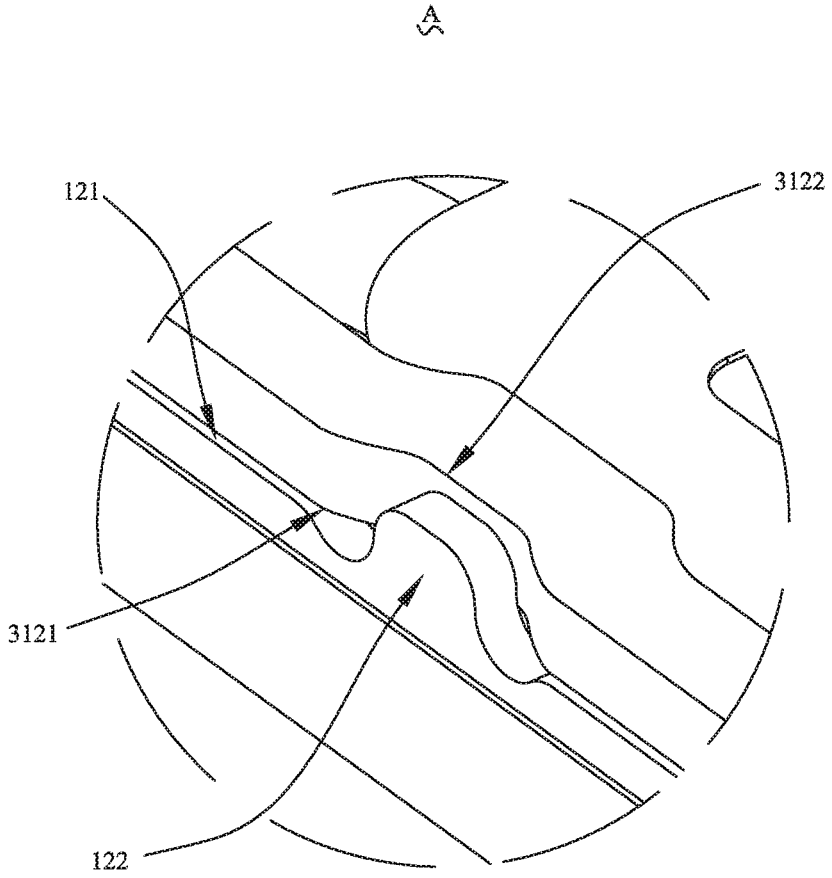
FIG. 6 is a partially enlarged view of a position A shown in FIG. 5.

Referring to FIG. 2, FIG. 5 and FIG. 6, the corner portion 13 includes a third surface 131 facing away from the first diaphragm 41. The short edge 12 includes a first surface 121 facing away from the first diaphragm 41, and a protrusion 122 formed by extending from the first surface 121 in a direction facing away from the first diaphragm 41. In an embodiment, the first surface 121 is closer to the first diaphragm 41 than the third surface 131. For example, the protrusion 122 is provided at a middle position of the short edge 12. Further, in an embodiment, the protrusion 122 extends from the first surface 121 in the direction facing away from the first diaphragm 41 to be flush with the third surface 131.

The short-axis edge 312 abuts against the first surface 121. The short-axis edge 312 includes a second surface 3121 facing towards the short edge 12, and an avoiding portion 3122 formed by recessing from the second surface 3121 in a direction facing away from the short edge 12. The protrusion 122 is received in and fixedly connected to the avoiding portion 3122.

For example, the protrusion 122 and the avoiding portion 3122 are welded and fixed by laser spot welding. It is also possible that the protrusion 122 and the avoiding portion 3122 are fixed by other methods, such as glue bonding.

For example, the corner portion 13 and the clamp plate 31 are fixed to each other in the same manner as the protrusion 122 and the avoiding portion 3122.

A recessing depth of the avoiding portion 3122 is equal to a thickness of the protrusion 122, and the thickness refers to a distance between a surface of the protrusion 122 facing the holder 1 and a surface of the protrusion 122 facing the clamp plate 31.

Compared with the related art, the speaker provided by the present disclosure is additionally provided with a protruding protrusion in the middle of the short edge of the holder, and the clamp plate is provided with the avoiding portion for matching the protrusion. The structure, which is formed by fixing the corner portion and the protrusion of the holder to the clamp plate with laser welding, can ensure that deformation and warping of the short edges of the metal holder are avoided after a dropping test.

The above described embodiments are merely intended to illustrate the present disclosure, and it should be noted that, without facing away from the inventive concept of the present disclosure, the improvements made by those skilled in the related art shall fall within the protection scope of the present disclosure.

What is claimed is:

1. A speaker, comprising:

a metal holder;

a magnetic circuit unit mounted on the holder; and a vibration unit mounted on the holder, wherein the vibration unit comprises a first diaphragm fixed to one end of the holder, and the magnetic circuit unit comprises a yoke, a main magnet assembled at a center of the yoke, two auxiliary magnets assembled on the yoke and respectively located on two opposite sides of the main magnet, and a clamp plate assembled on the two auxiliary magnets, the clamp plate comprises two long-axis edges opposite to each other, and two short-axis edges opposite to each other, the two long-axis edges and the two short-axis edges are connected end to end to form the clamp plate, the two long-axis edges are respectively attached to surfaces of the two auxiliary magnets, the holder comprises two long edges opposite to each other, two short edges opposite to each other, and corner portions, each corner portion connects a long edge and an adjacent short edge, each of the two short edges comprises a first surface facing away from the first diaphragm, the two short-axis edges respectively abut against the first surfaces of the two short edges, each of the two short-axis edges comprises a second surface facing away from the main magnet, each of the corner portions comprises a third surface facing away from the first diaphragm, and the first surface is closer to the first diaphragm than the third surface, each end of the short-axis edges laterally abuts against a corresponding corner portion, each short edge is provided with a protrusion extending from the first surface in a direction facing away from the first diaphragm, each short-axis edge is provided with an avoiding portion formed by recessing from the second surface in a direction facing away from the adjacent short edge, the protrusion is received in and fixedly connected to the corresponding avoiding portion.

2. The speaker as described in claim 1, wherein the protrusion is provided at a middle portion of each of the two short edges.

3. The speaker as described in claim 2, wherein the protrusion and the avoiding portion are fixed by laser welding.

4. The speaker as described in claim 2, wherein the corner portions and the clamp plate are fixed by laser welding.

5. The speaker as described in claim 1, wherein the protrusion extending from the first surface in the direction facing away from the first diaphragm is flush with the third surface.

6. The speaker as described in claim 1, wherein a recessing depth of the avoiding portion is equal to a thickness of the protrusion.

7. The speaker as described in claim 1, wherein the vibration unit further comprises a voice coil located below the first diaphragm and configured to drive the first diaphragm to vibrate and emit sound, a second diaphragm fixed to the other end of the holder, and a flexible printed circuit board elastically supporting the voice coil and electrically connected to the voice coil, the flexible printed circuit board being interposed between the voice coil and the second diaphragm.

* * * * *